US007794198B2

(12) United States Patent
Omori et al.

(10) Patent No.: US 7,794,198 B2
(45) Date of Patent: Sep. 14, 2010

(54) CENTRIFUGAL FAN AND APPARATUS USING THE SAME

(75) Inventors: Kazuya Omori, Aichi (JP); Kazuo Ogino, Aichi (JP); Takaaki Nakasone, Aichi (JP)

(73) Assignee: Panasonic Corporation, Osaka (JP)

( * ) Notice: Subject to any disclaimer, the term of this patent is extended or adjusted under 35 U.S.C. 154(b) by 1090 days.

(21) Appl. No.: 10/561,770

(22) PCT Filed: Jun. 22, 2004

(86) PCT No.: PCT/JP2004/009083

§ 371 (c)(1),
(2), (4) Date: Dec. 21, 2005

(87) PCT Pub. No.: WO2005/003566

PCT Pub. Date: Jan. 13, 2005

(65) Prior Publication Data

US 2006/0177304 A1 Aug. 10, 2006

(30) Foreign Application Priority Data

Jun. 23, 2003 (JP) ..... 2003-177979
Jul. 15, 2003 (JP) ..... 2003-274695

(51) Int. Cl.
*F04D 29/28* (2006.01)
*F04D 29/68* (2006.01)

(52) U.S. Cl. ..... 415/119; 415/206; 416/236 R

(58) Field of Classification Search ..... 416/500, 416/236 R, 223 B, 187; 415/119
See application file for complete search history.

(56) References Cited

U.S. PATENT DOCUMENTS 465,439 A * 12/1891 Vinal ..... 416/224
4,647,271 A * 3/1987 Nagai et al. ..... 416/186 R
5,169,290 A * 12/1992 Chou ..... 416/236 R

FOREIGN PATENT DOCUMENTS

| | | | |
|---|---|---|---|
| JP | 51-118108 | | 9/1976 |
| JP | 58-64895 U | | 5/1983 |
| JP | 60-19994 A | | 2/1985 |
| JP | 60-166793 A | | 8/1985 |
| JP | 62-271995 A | | 11/1987 |
| JP | 2-114800 U | | 9/1990 |
| JP | 2-248693 A | | 10/1990 |
| JP | 06193593 A | * | 7/1994 |
| JP | 06241195 A | * | 8/1994 |
| JP | 7-4388 A | | 1/1995 |

(Continued)

OTHER PUBLICATIONS

JPO Machine Translation: JP 2002-168194 A. JPO website accessed Jun. 12, 2009. pp. 1-6.*

(Continued)

*Primary Examiner*—Richard Edgar
(74) *Attorney, Agent, or Firm*—RatnerPrestia

(57) ABSTRACT

A lateral plate and a main plate are provided inside a casing, and a plurality of blades are circularly arranged on this main plate. A plurality of asperities are formed from the front blade edge toward the rear blade edge on at least one of dorsal and ventral sides of each blade.

28 Claims, 19 Drawing Sheets

FOREIGN PATENT DOCUMENTS

| | | | | |
|---|---|---|---|---|
| JP | 07004388 | A | * | 1/1995 |
| JP | 7-247999 | A | | 9/1995 |
| JP | 9-195988 | A | | 7/1997 |
| JP | 11-294386 | A | | 10/1999 |
| JP | 11294386 | A | * | 10/1999 |
| JP | 2001-032794 | A | | 2/2001 |
| JP | 2001032794 | A | * | 2/2001 |
| JP | 2001-271791 | A | | 10/2001 |
| JP | 2002-168194 | A | | 6/2002 |
| JP | 2002168194 | A | * | 6/2002 |
| JP | 2002-317797 | A | | 10/2002 |

OTHER PUBLICATIONS

International Search Report for PCT/JP2004/009083, dated Oct. 26, 2004.

* cited by examiner

CENTRIFUGAL FAN AND APPARATUS USING THE SAME

This application is a U.S. National Phase Application of PCT International Application PCT/3P2004/009083.

TECHNICAL FIELD

The present invention relates to a centrifugal fan used for a ventilating blower, air conditioner, dehumidifier, humidifier, or air purifier.

BACKGROUND ART

A conventional centrifugal fan used for a ventilating blower and air conditioner is disclosed in Japanese Patent Unexamined Publication No. 2002-168194.

Hereinafter, a description is made for this conventional multiblade fan with reference to FIGS. 15 through 20.

FIG. 15 is a sectional side view of a centrifugal fan and casing in the conventional example. FIG. 16 is a sectional view of its substantial part, illustrating a state of airflow between blades in the large air volume and low static pressure zone. FIG. 17 is its sectional side view, illustrating an effective work area in the large air volume and low static pressure zone. FIG. 18 is a sectional view of its substantial part, illustrating a state of airflow between blades in the small air volume and high static pressure zone. FIG. 19 is its sectional side view, illustrating a state of airflow in the small air volume and high static pressure zone. FIG. 20 is its performance characteristic diagram.

As shown in the figure, The spiral inside of casing 1104 is formed at its one side with bellmouth-like inlet 1101 and has discharge outlet 1103, and orifice 1102 with its internal diameter same as blade internal diameter D101. This casing 1104 is provided therein with ring-like lateral plate 1105, and main plate 1107 having throttle 1106 substantially truncated-cone-shaped, projecting toward this lateral plate 1105. A plurality of blades 1109 are attached so as to be interposed by lateral plate 1105 and main plate 1107. Plural blades 1109 has inlet angle 0101 of blade inlet 1108 and outlet angle 0102 of blade outlet 1109, both constant from lateral plate 1105 through main plate 1107. Main plate 1107, lateral plate 1105, and plural blades 1109 compose multiblade fan 1111. Shaft 1113 of motor 1112 mounted to casing 1104 is connected to main plate 1107.

As a result that multiblade fan 1111 is rotated by motor 1112, inhaled air 1114 passes through inlet 1101 of inlet orifice 1102, to flow into blade inlet 1108. Air that has flown into blade inlet 1108 is pressurized between blades 1110, to flow out through blade outlet 109. The air that has flown out is gradually converted from dynamical pressure to static pressure when further passing through spiral casing 1104, to be discharged to discharge outlet 1103. This centrifugal fan changes a load (static pressure) on multiblade fan 1111 according to the length of a discharge duct connected to discharge outlet 1103, resulting in having various operating points from the large air volume and low static pressure zone to the small air volume and high static pressure zone.

In such a conventional centrifugal fan, as a result that the mainstream flows unevenly through the ventral zone of the blades at an operating point in the large air volume and low static pressure zone, exfoliation tends to occur at the dorsal side of the blades. Consequently, the total pressure efficiency decreases to cause turbulent flow noise. Therefore, improving aerodynamic performance with lower noise is demanded.

Next, a description is made for the conventional example disclosed in Japanese Patent Unexamined Publication No. 2001-271791 with reference to some drawings.

FIG. 30 is a sectional side view of a centrifugal fan and casing in another conventional example. FIGS. 31 and 32 are a sectional view and a top view of their substantial parts, respectively.

Spiral casing 2104 is formed at its one side with bellmouth-like inlet 2101 and has orifice 2102 with the same internal diameter as that of the fan and discharge outlet 2103. Casing 2104 is provided therein with main plate 2105, flat and vertical to the rotation axis; a plurality of blades 2106 disposed above and below main plate 2105; and ring-shaped lateral plate 2107 at both sides of the blades. Main plate 2105 is formed thereon with ventilating hole 2108 for air to circulate from top blade 2106*a* to bottom blade 2106*b*. Top blade 2106*a* has blade inlet angle θ201 and blade outlet angle θ202 different from those of bottom blade 2106*b*. Shaft 2019 of motor 2110 mounted to casing 2104 is connected to main plate 2105. Main plate 2105, lateral plate 2107, and plural blades 2106 compose the multiblade fan.

As a result that motor 2110 rotates, the inhaled air passes through inlet 2101 of orifice 2102, to flow into the blade inlet. The air that has flown in is pressurized between blades 2106, to flow out through the blade outlet. The air that has flown out is gradually converted from dynamical pressure to static pressure when passing through spiral casing 2104, to be discharged to discharge outlet 2103. This centrifugal fan changes a load (static pressure) on the multiblade fan according to the length of a discharge duct connected to discharge outlet 2103. That is, the centrifugal fan has various operating points from the large air volume and low static pressure zone to the small air volume and high static pressure zone.

In such a conventional centrifugal fan, in order to expand to the lateral plate the range of the mainstream unevenly distributed in the main plate, at an operating point in the large air volume and low static pressure zone, blades with different inlet angles and outlet angles are arranged on the top and bottom of the main plate. In such a makeup, the mainstream flows to the bottom blades through the ventilating hole. That is, when passing through the ventilating hole, the mainstream strikes against the main plate and increases its velocity. Then, the flow velocity increases between bottom blades, causing a blade surface to be exfoliated. Consequently, the total pressure efficiency decreases and noise increases.

Meanwhile, at an operating point in the small flow volume and high static pressure zone, the mainstream shifts from blades at the main plate to those at the lateral plate, and the difference between the outlet angle of the top blade and the discharge angle increases if the outlet angle is constant from the main plate through the lateral plate, causing the exfoliation zone to be expanded near the blade outlet. Accordingly, noise tends to occur, and thus improving aerodynamic performance with lower noise is demanded.

SUMMERY OF THE INVENTION

The present invention has been made in view of the problems in the above-mentioned conventional example.

A centrifugal fan according to the present invention is equipped with a plurality of blades arranged circularly, where the blades are interposed between a ring-like lateral plate and a main plate to be integrated;

a casing provided with a plurality of blades arranged circularly, where the casing has a discharge outlet, and a bellmouth-like inlet with the same internal diameter as that of plural blades circularly arranged; and a motor with its rotation axis connected to the main plate, where the motor is fixed to the casing. Further, each of the plural blades has a plurality of asperities on at least one of the dorsal and ventral sides. The plural blades at the lateral plate side are arranged at the inlet side. In a cross section vertical to the rotation axis of the plural blades, the plural asperities are formed with a projection and a recess alternately repeated from the front edge toward the rear edge.

Further, the centrifugal fan according to the present invention is equipped with a plurality of blades arranged circularly, where the plural blades are interposed between a ring-like lateral plate and a main plate to be integrated;

a casing provided with plural blades arranged circularly, where the casing has a discharge outlet, and a bellmouth-like inlet with the same internal diameter as that of plural blades circularly arranged; and a motor with its rotation axis connected to the main plate, where the motor is fixed to the casing. Further, the outlet angle at the outer circumference of the plural blades gradually changes from the main plate toward the lateral plate.

DETAILED DESCRIPTION OF PREFERRED EMBODIMENTS

Hereinafter, a description is made for exemplary embodiments of the present invention with reference to drawings.

First Exemplary Embodiment

Figure 1:
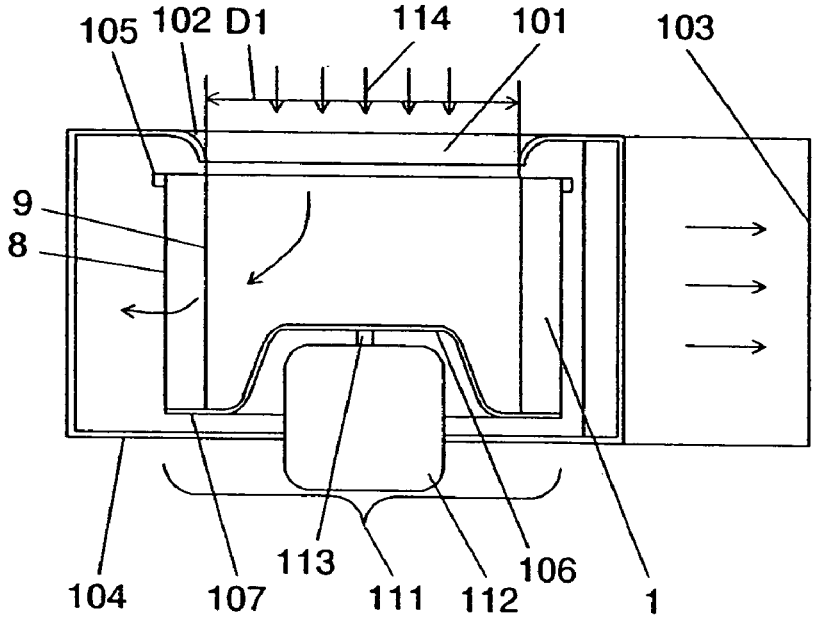
FIG. 1 is a sectional side view of a centrifugal fan and casing according to the first exemplary embodiment of the present invention.
Figure 2:
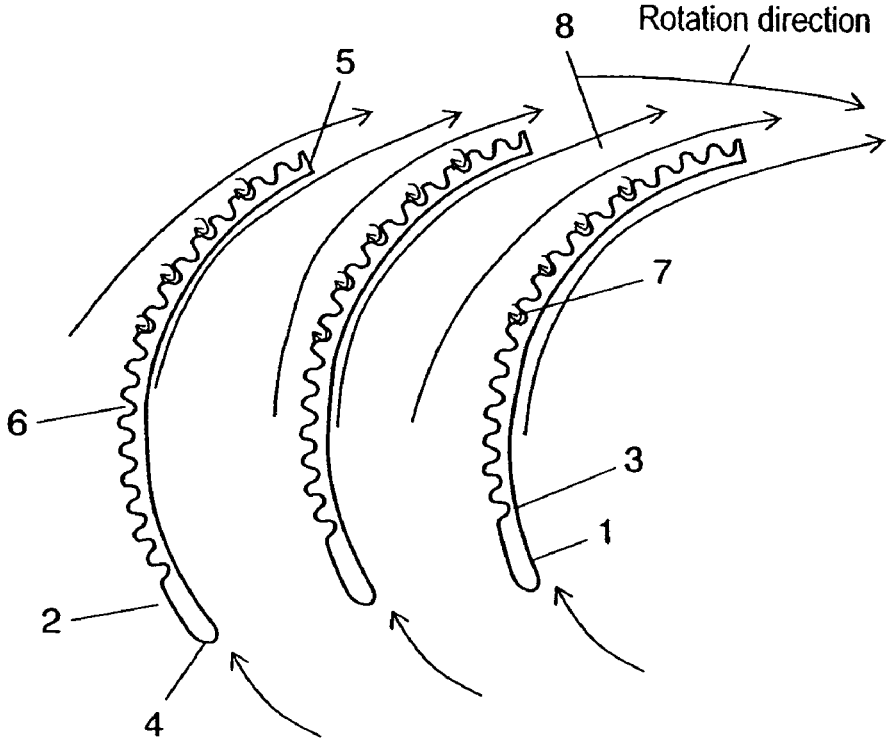
FIG. 2 is a sectional view of the blade shape of the same centrifugal fan.
Figure 3:
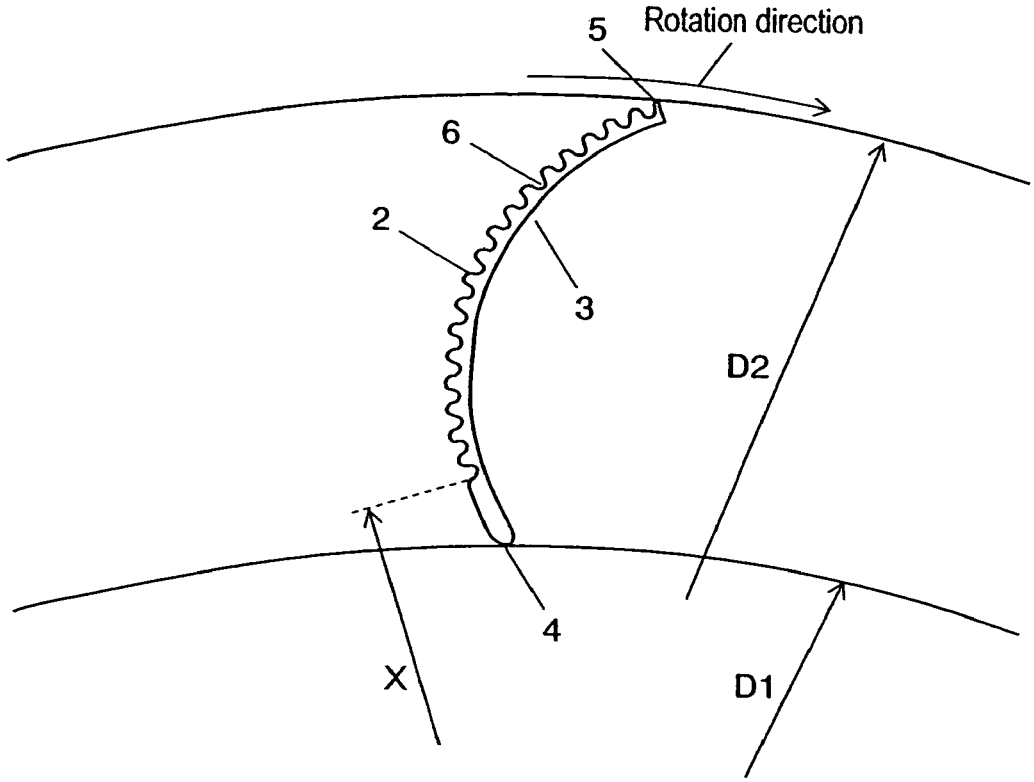
FIG. 3 is an explanatory diagram illustrating the specifications of the asperities of the same centrifugal fan.
Figure 4A:
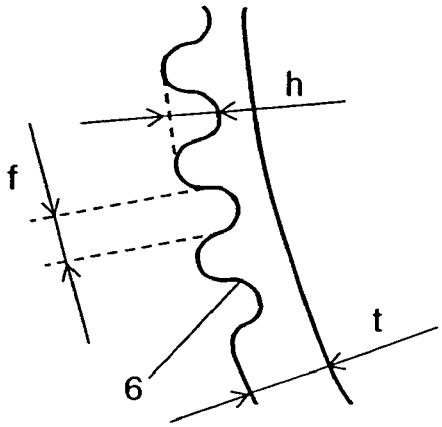
FIGS. 4A and 4B are explanatory diagrams illustrating the specifications of the asperities of the same centrifugal fan.
Figure 4B:
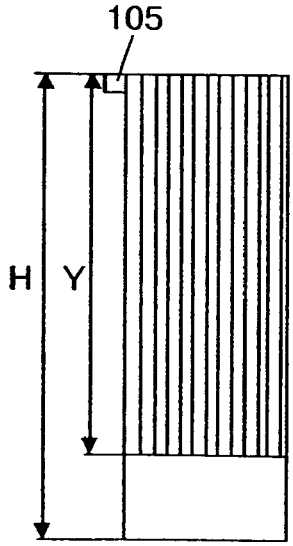
Figure 5A:
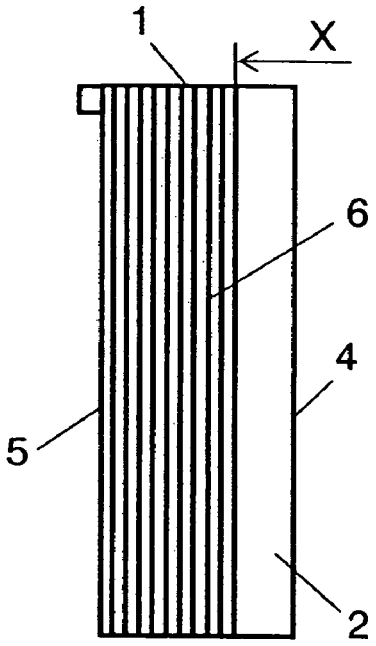
FIGS. 5A and 5B are explanatory diagrams illustrating the installation mode and specifications of the asperities of the same centrifugal fan, in the axial direction.
Figure 5B:
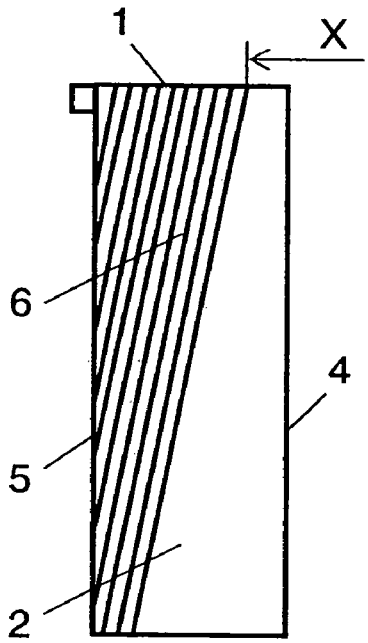
Figure 7:
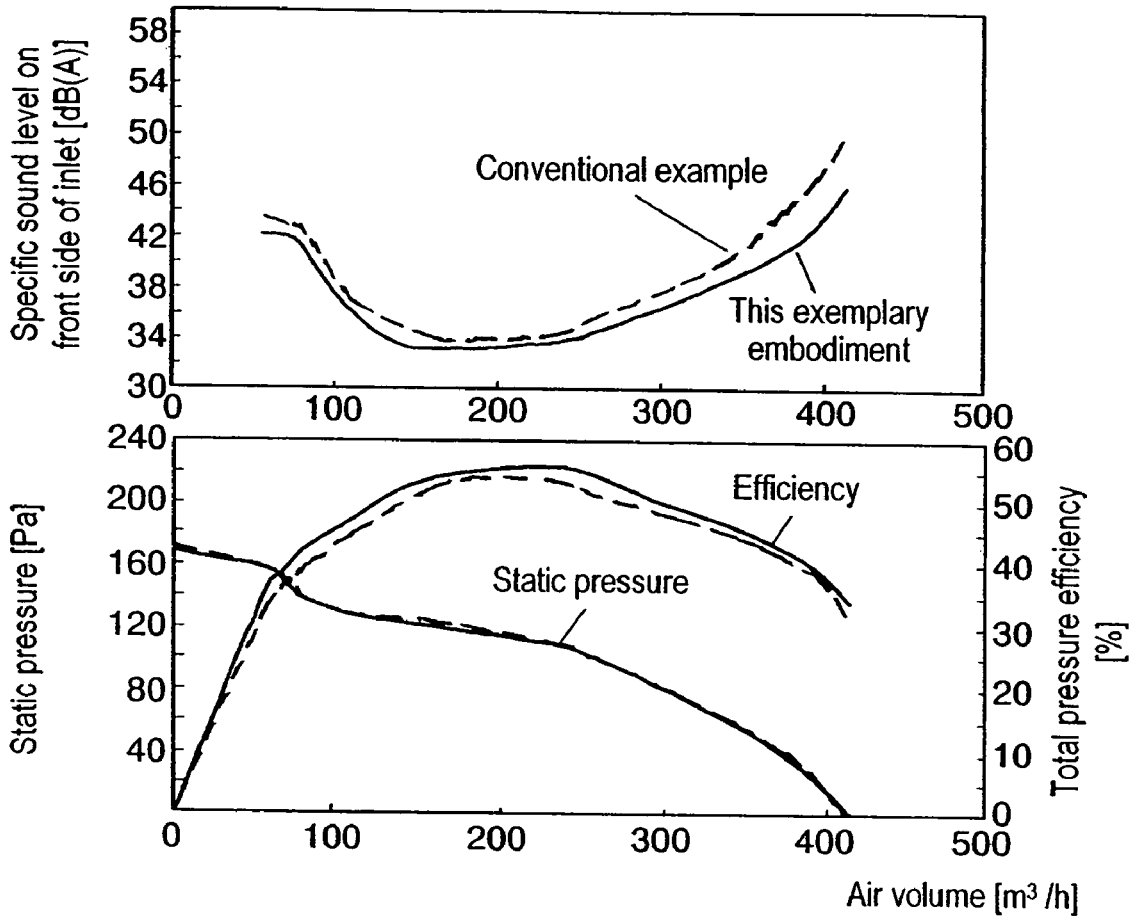
FIG. 7 is a performance characteristic diagram of the same centrifugal fan.
Figure 8:
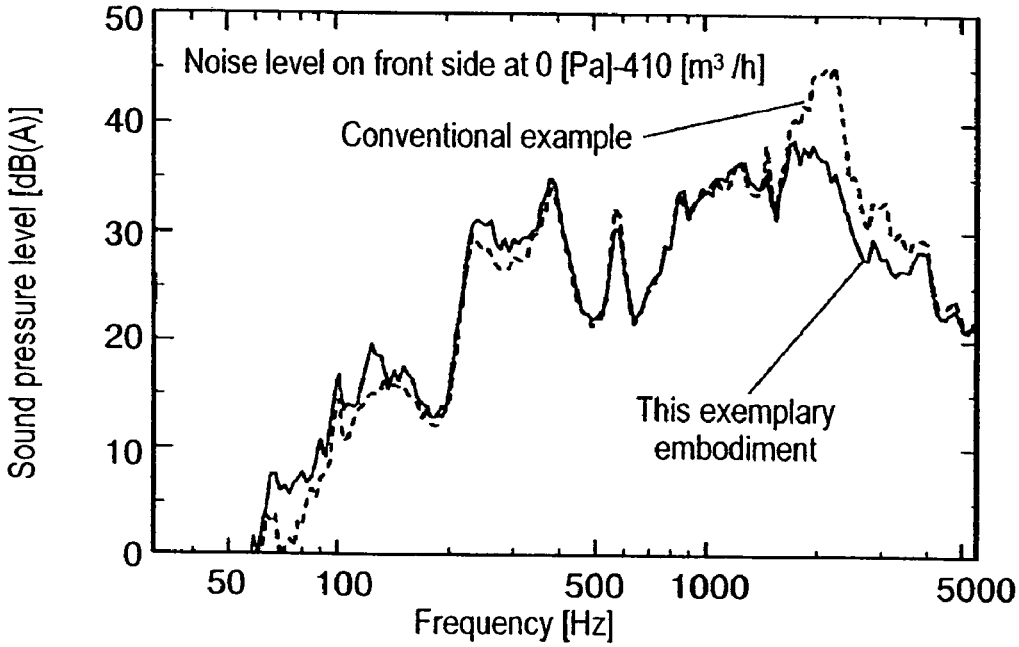
FIG. 8 is a performance characteristic diagram of the same centrifugal fan.

FIG. 1 is a sectional side view of the centrifugal fan and casing according to the first exemplary embodiment of the present invention. FIG. 2 illustrates a cross section of blades of the centrifugal fan, taken along a line vertical to the rotation axis, along with the airflow. FIGS. 3, 4A, and 4B illustrate the specifications of the shape of the asperities provided on a blade. FIGS. 5A and 5B illustrate the installation mode and specifications of the asperities, in the axial direction. FIGS. 6A through 6G illustrate types of the shape of the asperities provided on a blade. FIGS. 7 and 8 illustrate a performance characteristic in this embodiment.

As shown in the figure, spiral casing 104 is formed at its one side with bellmouth-like inlet 101, and has orifice 102 with the same internal diameter as blade internal diameter D1 and discharge outlet 103. This casing 104 is provided therein with ring-like lateral plate 105, and main plate 107 having throttle 106 substantially truncated-cone-shaped and projecting toward lateral plate 105. A plurality of blades 1 are attached so as to be interposed between lateral plate 105 and main plate 107. The plural blades 1 are arranged circularly. Main plate 107, lateral plate 105, and plural blades 1 compose multiblade fan 111. Shaft 113 of motor 112 mounted to casing 104 is connected to main plate 107.

As a result that multiblade fan 111 is rotated by motor 112, inhaled air 114 passes through inlet 101 of inlet orifice 102, to flow into blade inlet 9. The air that has flown into blade inlet 9 is pressurized between blades 1, to flow out through blade outlet 8. The air that has flown out is gradually converted from dynamical pressure to static pressure when passing through spiral casing 104, to be discharged to discharge outlet 103.

As shown in FIG. 2, dorsal side 2 of blade 1 is formed thereon with a plurality of asperities 6 from front blade edge 4 toward rear blade edge 5. Such a makeup causes microscopic eddies 7 to be formed on asperities 6. This makeup allows air exfoliation occurring at dorsal blade side 2 to be reduced in the large air volume and low static pressure zone, and thus the mainstream range unevenly distributed at ventral blade side 3 can be expanded to dorsal blade side 2. Resultingly, turbulence from blade outlet 8 can be minimized.

A description is made for the detailed specifications of asperities 6 with reference to FIGS. 3, 4A, and 4B.

The ratio between h: the depth of a recess of asperities 6, and t: the board thickness of a blade, is to be $0.1<h$ and $t<0.7$.

The ratio between f: the width of a recess of asperities 6, and depth h is to be $0.5\ h<f<2.5\ h$.

The ratio between Y: the distance of the asperities from lateral plate 105 along the rotation axis, and H: the height of a blade, is to be $0.1<Y$ and $H<1.0$.

The relationship among X: the distance from the rotation center of rotation axis 113 to the starting point of asperities 6; D1: the internal of diameter of the fan (plural blades 1 circularly formed); and D2: the external diameter of the fan, is to be $D1<2X<D1+0.35(D2-D1)$.

An installation mode of asperities 6 in the axial direction are assumed to be those shown in FIG. 5A or 5B.

Here, some shapes shown in FIGS. 6A through 6G may be applied to the shape of asperities 6 in a cross section vertical to the rotation axis of blade 1.

Figure 6A:
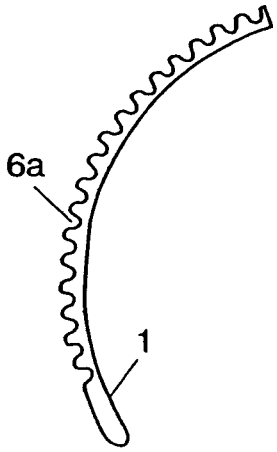
FIGS. 6A through 6G are sectional views of the asperities of a blade of the same centrifugal fan.
Figure 6B:
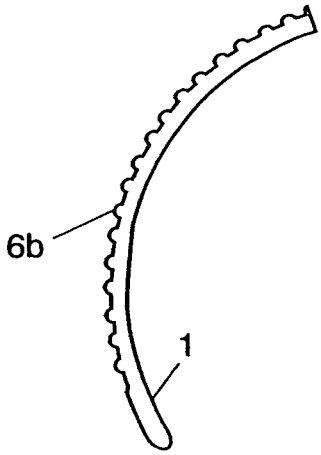
Figure 6C:
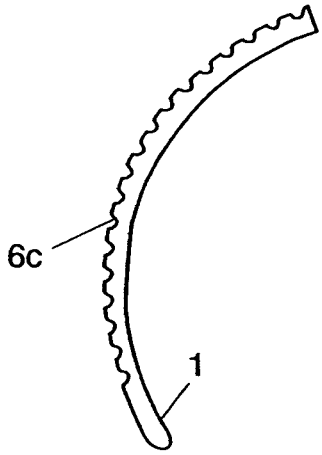
Figure 6D:
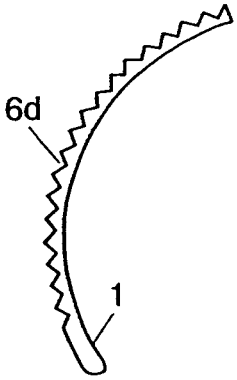
Figure 6E:
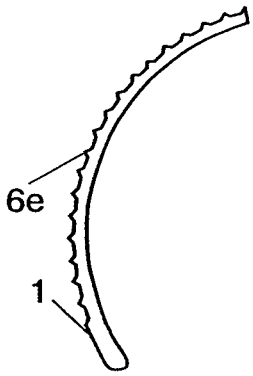
Figure 6F:
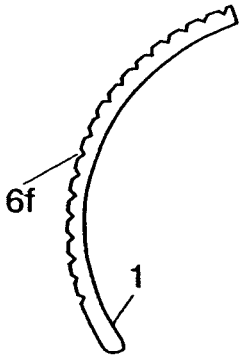
Figure 6G:
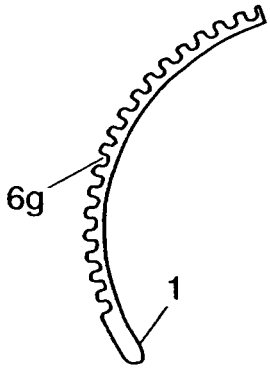

The shape of asperities 6*a* shown in FIG. 6A is a continuous arc. The shape of a projection of asperities 6*b* shown in FIG. 6B is an arc. The shape of a recess of asperities 6*c* shown in FIG. 6C is an arc. The shape of asperities 6*d* shown in FIG. 6D is formed with continuous substantial triangles. The shape of a recess of asperities 6*d* shown in FIG. 6E is substantially triangle. The shape of a projection of asperities 6*f* shown in FIG. 6F is substantially triangle. The shape of asperities 6*g* shown in FIG. 6G is formed with continuous substantial quadrangles.

FIG. 7 illustrates a comparison result of performance characteristic of this embodiment with that of the conventional example. In this embodiment, noise characteristic and total pressure efficiency are improved over the entire zone of the air volume and static pressure characteristic. FIG. 8 illustrates a frequency characteristic of noise at 0 Pa and 410 $m^3$/h. In the exemplary embodiment, the sound pressure level is significantly reduced around 2,000 Hz.

Second Exemplary Embodiment

Figure 9:
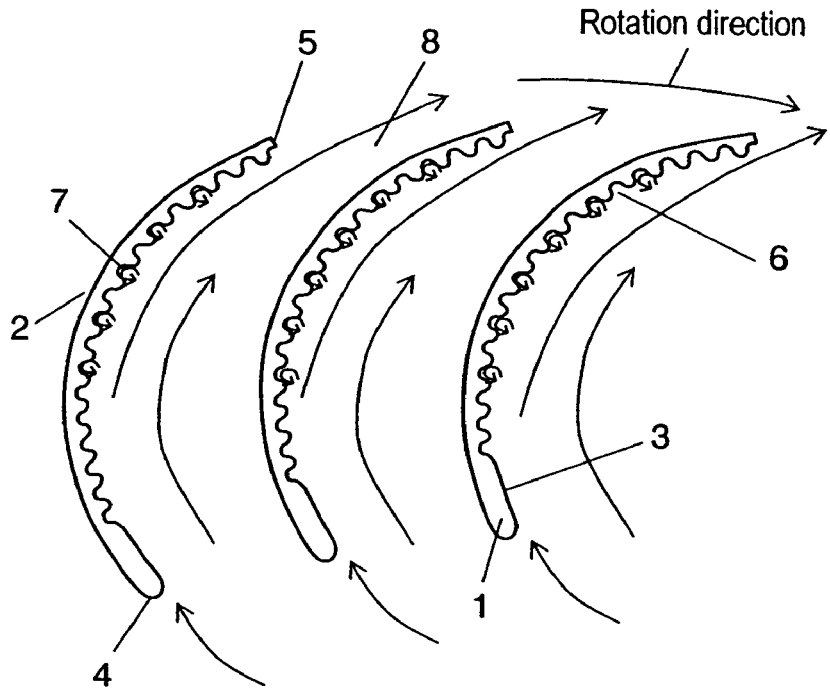
FIG. 9 is a sectional view of the blade shape of the centrifugal fan according to the second exemplary embodiment of the present invention.
Figure 10:
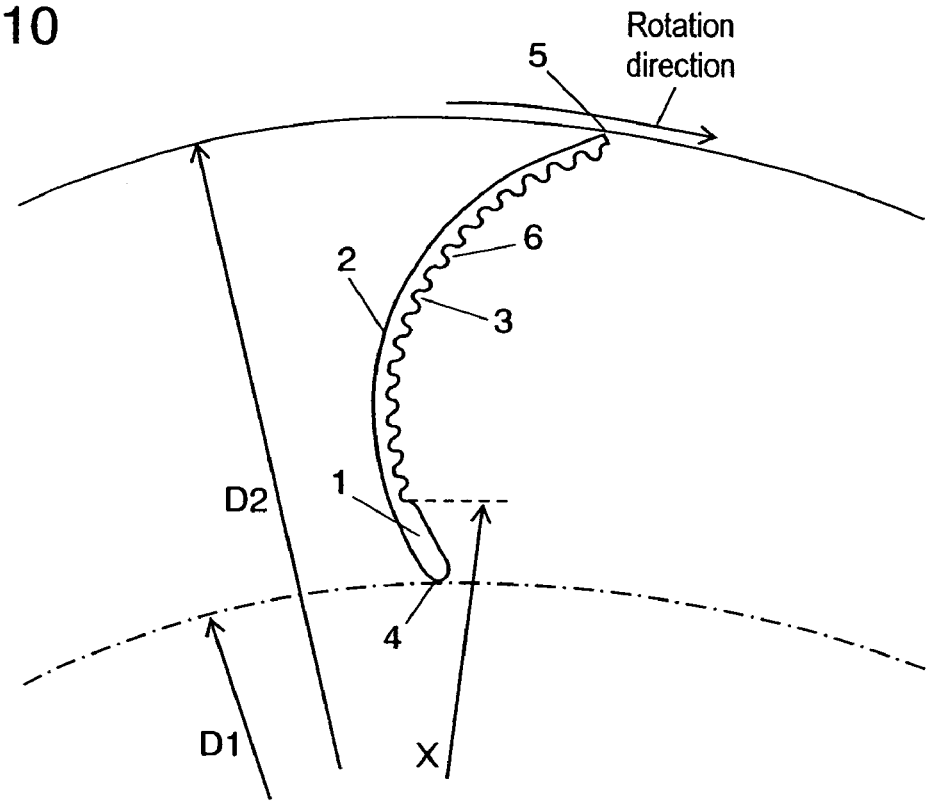
FIG. 10 is an explanatory diagram illustrating the specifications of the asperities of the same centrifugal fan.
Figure 11A:
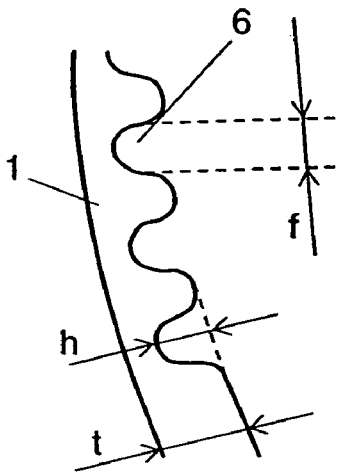
FIGS. 11A and 11B are explanatory diagrams illustrating the specifications of the asperities of the same centrifugal fan.
Figure 11B:
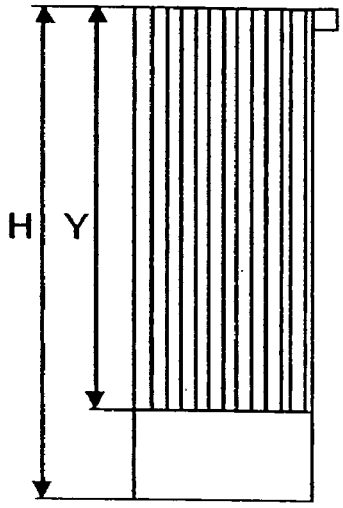
Figure 12A:
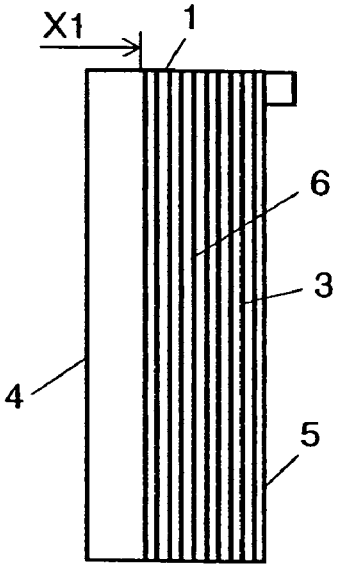
FIGS. 12A and 12B are explanatory diagrams illustrating the installation mode and specifications of the asperities of the same centrifugal fan, in the axial direction.
Figure 12B:
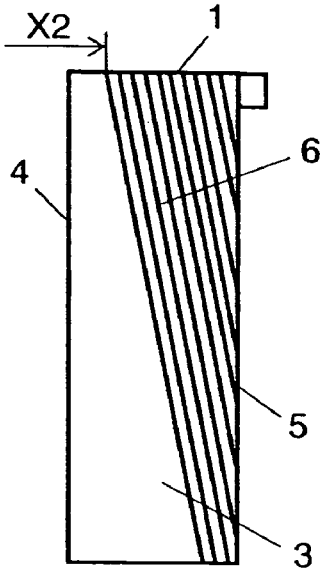
Figure 13A:
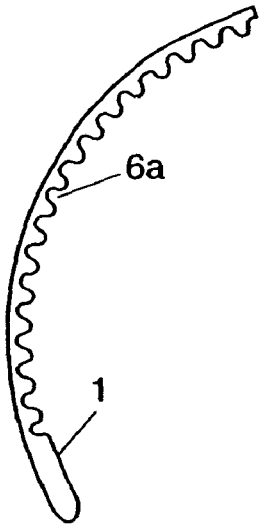
FIGS. 13A through 13G are sectional views of the asperities of a blade of the same centrifugal fan.
Figure 13B:
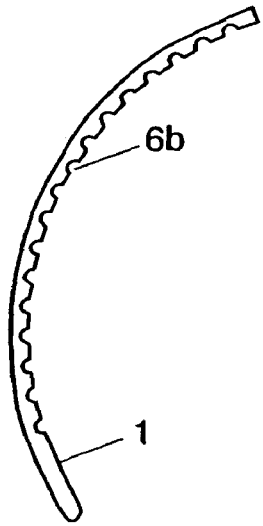
Figure 13C:
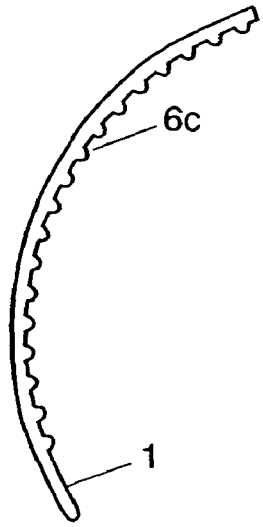
Figure 13D:
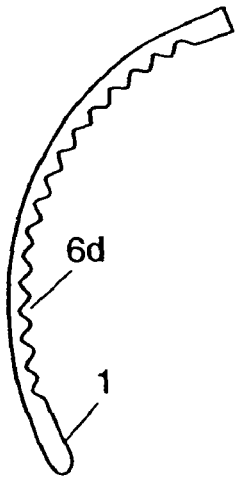
Figure 13E:
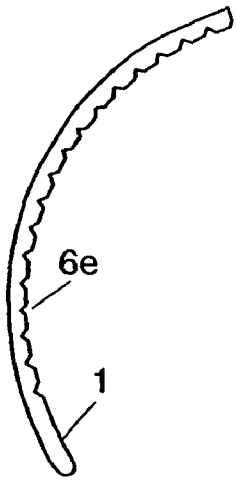
Figure 13F:
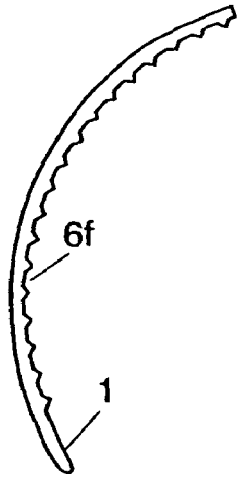
Figure 13G:
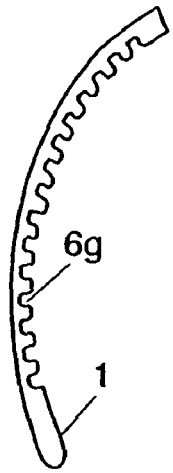

FIG. 9 illustrates a cross section of the centrifugal fan according to the second exemplary embodiment of the present invention, taken along a line vertical to the rotation axis of a blade, along with the airflow. FIGS. 10, 11A, and 11B illustrate the specifications of the shape of the asperities provided on a blade. FIGS. 12A and 12B illustrate the installation mode and specifications of the asperities in the axial direction. FIGS. 13A through 13G illustrate types of the shape of the asperities provided on a blade.

In this embodiment, for a component with a makeup same as that in the above-mentioned exemplary embodiment, the same mark is given to omit its description. This embodiment is different from the first exemplary embodiment in the shape of blades.

As shown in FIG. 9, blade 1 in this embodiment, unlike the first exemplary embodiment, is formed with a plurality of asperities 6 at ventral blade side 3 from front blade edge 4 toward rear blade edge 5. Such a makeup causes microscopic eddies 7 to be formed on asperities 6 at ventral blade side 3. This makeup allows airflow exfoliation from blade inlet 9 and development of a boundary layer to be suppressed, and thus turbulence from blade outlet 8 can be minimized.

A description is made for the detailed specifications of asperities 6 according to this embodiment with reference to FIGS. 10, 11A, and 11B.

The ratio between h: the depth of a recess of asperities 6, and t: the board thickness of a blade, is to be $0.1<h$ and $t<0.7$.

The ratio between f: the width of a recess of asperities 6, and depth h is to be $0.5\ h<f<2.5\ h$.

The ratio between Y: the distance of the asperities from lateral plate 105 along the rotation axis, and H: the height of a blade, is to be $0.1<Y$ and $H<1.0$.

The relationship among X: the distance from the rotation center of rotation axis 113 to the starting point of asperities 6; D1: the internal diameter of the fan; and D2: the external diameter of the fan, is to be $D1<2X<D1+0.35(D2-D1)$.

An installation mode of asperities 6 in the axial direction is assumed to be one shown in FIG. 12A or 12B.

Here, the shape of asperities 6 in a cross section vertical to the rotation axis of blade 1 may be those shapes as shown in FIGS. 13A through 13G.

The shape of asperities 6*a* shown in FIG. 7A is formed with continuously repeated arcs. The shape of a recess of asperities 6*b* shown in FIG. 7B is an arc. The shape of a projection of asperities 6*c* shown in FIG. 7C is an arc. The shape of asperities 6*d* shown in FIG. 6D is formed with substantial triangles continuously repeated. The shape of a recess of asperities 6*d* shown in FIG. 6E is substantially triangle. The shape of a projection of asperities 6*f* shown in FIG. 6F is substantially triangle. The shape of asperities 6*g* shown in FIG. 6G is formed with substantial quadrangles continuously repeated.

Third Exemplary Embodiment

This embodiment is the same as the first and second exemplary embodiments except that asperities are formed at both dorsal blade side 2 and ventral blade side 3 of blade 1.

More specifically, an asperities is formed at dorsal blade side 2 of blade 1, in the same way as in the first exemplary embodiment; and ventral blade side 3, as in the second exemplary embodiment.

In the large air volume and low static pressure zone, development of a boundary layer occurring between blades, which is caused by microscopic eddies 7 occurring on asperities 6 at blade ventral side 2 and blade dorsal side 1, can be suppressed. Further, reattaching airflow that has exfoliated from blade 1 allows turbulence from blade outlet 8 to be minimized.

In the low air volume and high static pressure zone, exfoliation of airflow from blade inlet 9 and development of a boundary layer are suppressed to minimize turbulence from blade outlet 8.

Forth Exemplary Embodiment

Figure 14:
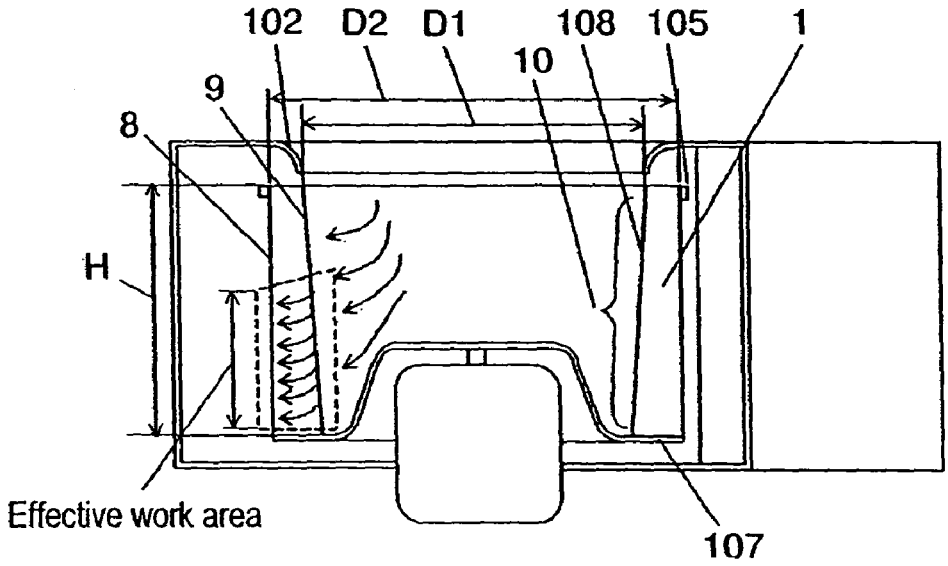
FIG. 14 is a sectional side view of the centrifugal fan and casing according to the fourth exemplary embodiment of the present invention.
Figure 15:
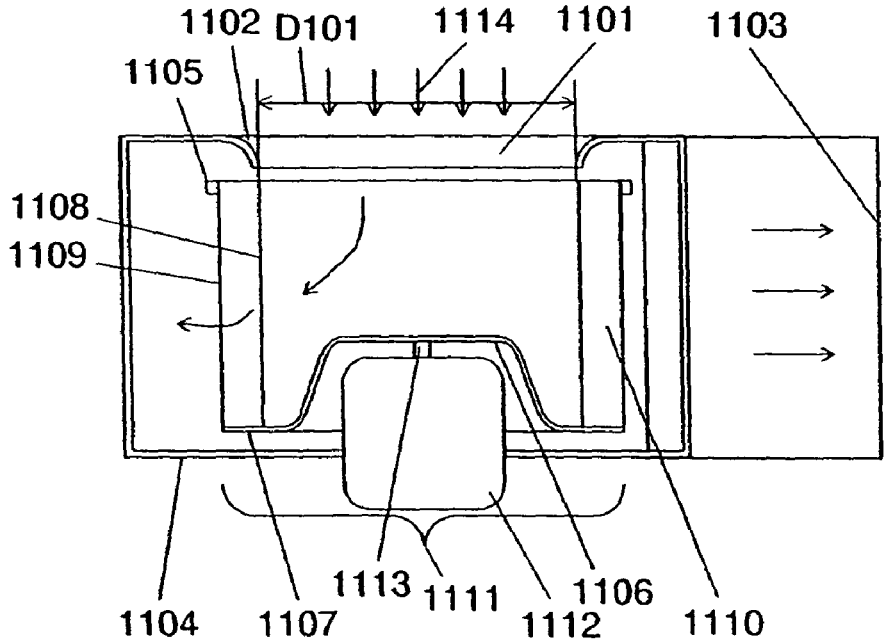
FIG. 15 PRIOR ART
FIG. 15 is a sectional side view of the centrifugal fan and casing in the conventional example.
Figure 16:
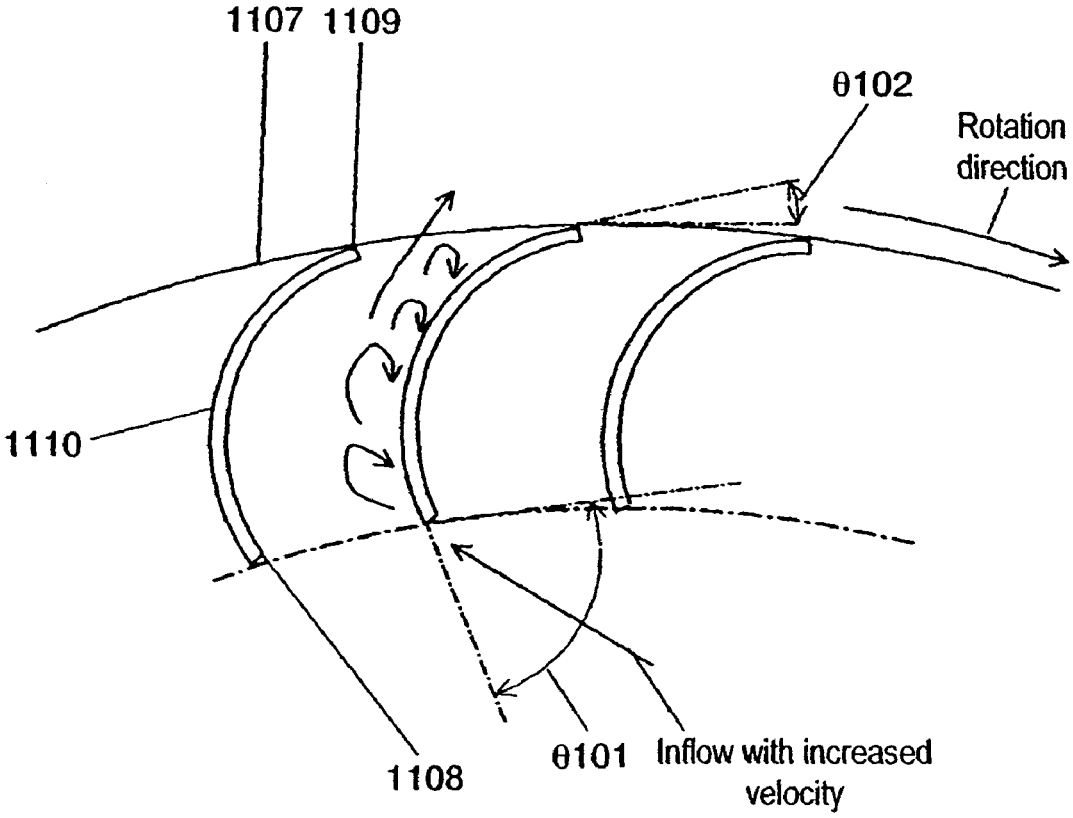
FIG. 16 PRIOR ART
FIG. 16 is a sectional view of its substantial part.
Figure 17:
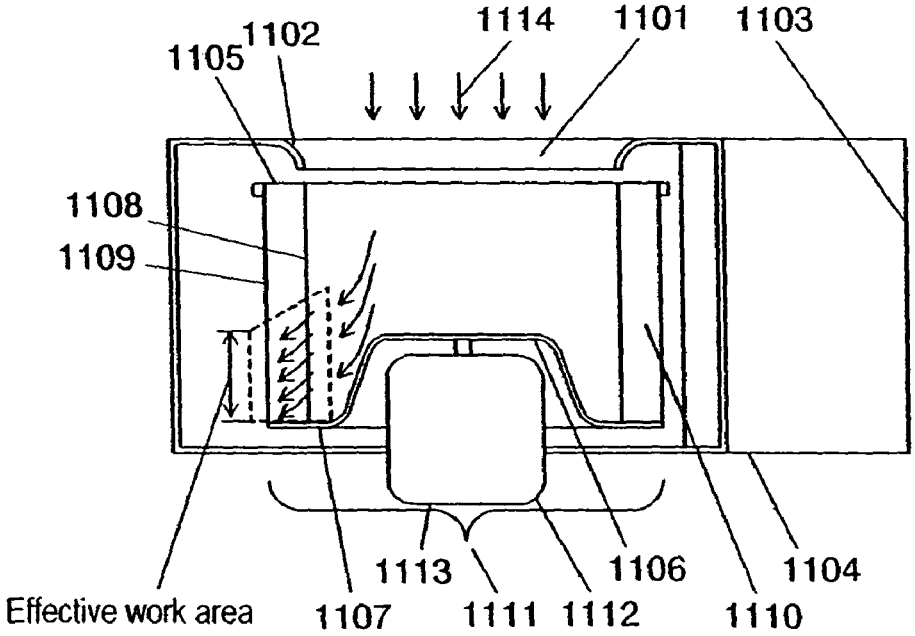
FIG. 17 PRIOR ART
FIG. 17 is its sectional side view.
Figure 18:
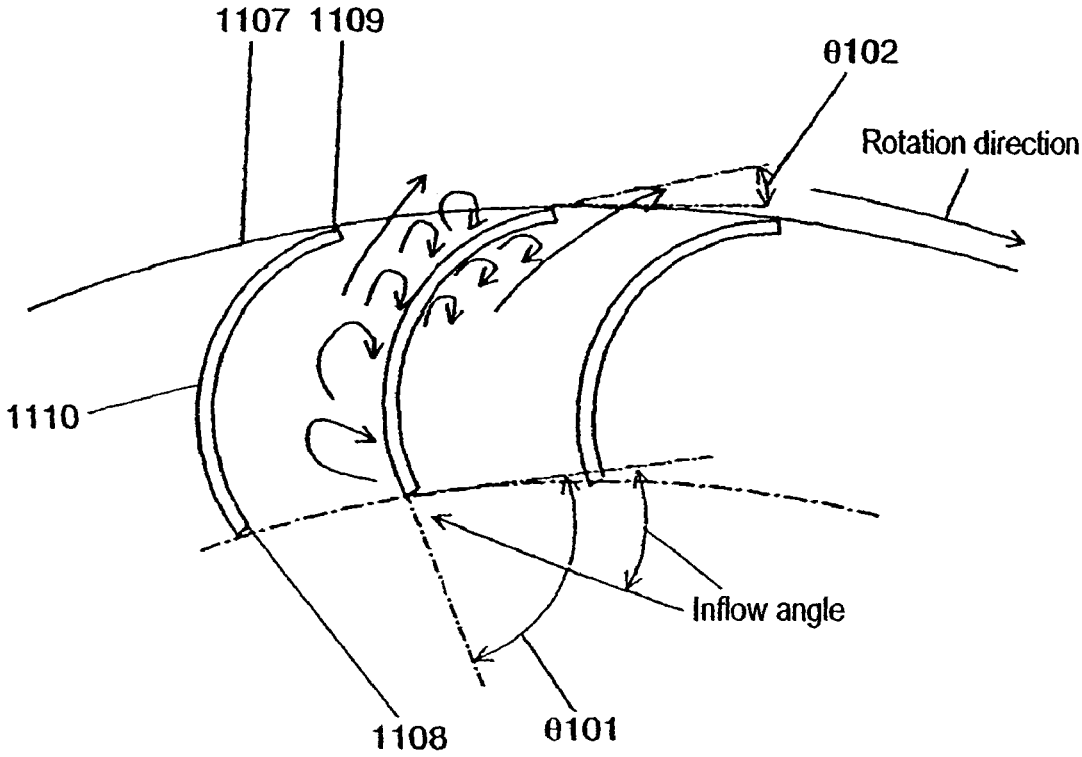
FIG. 18 PRIOR ART
FIG. 18 is a sectional view of its substantial part.
Figure 19:
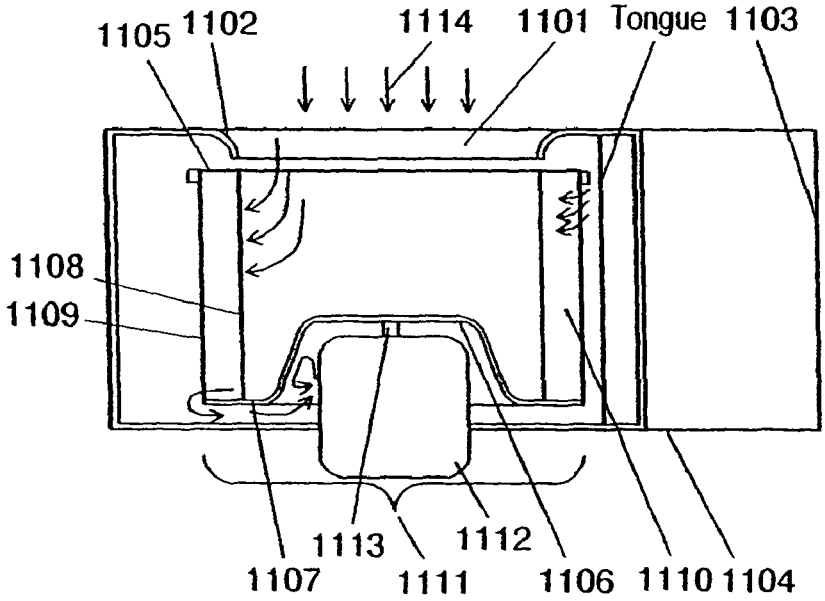
FIG. 19 PRIOR ART
FIG. 19 is its sectional side view.
Figure 20:
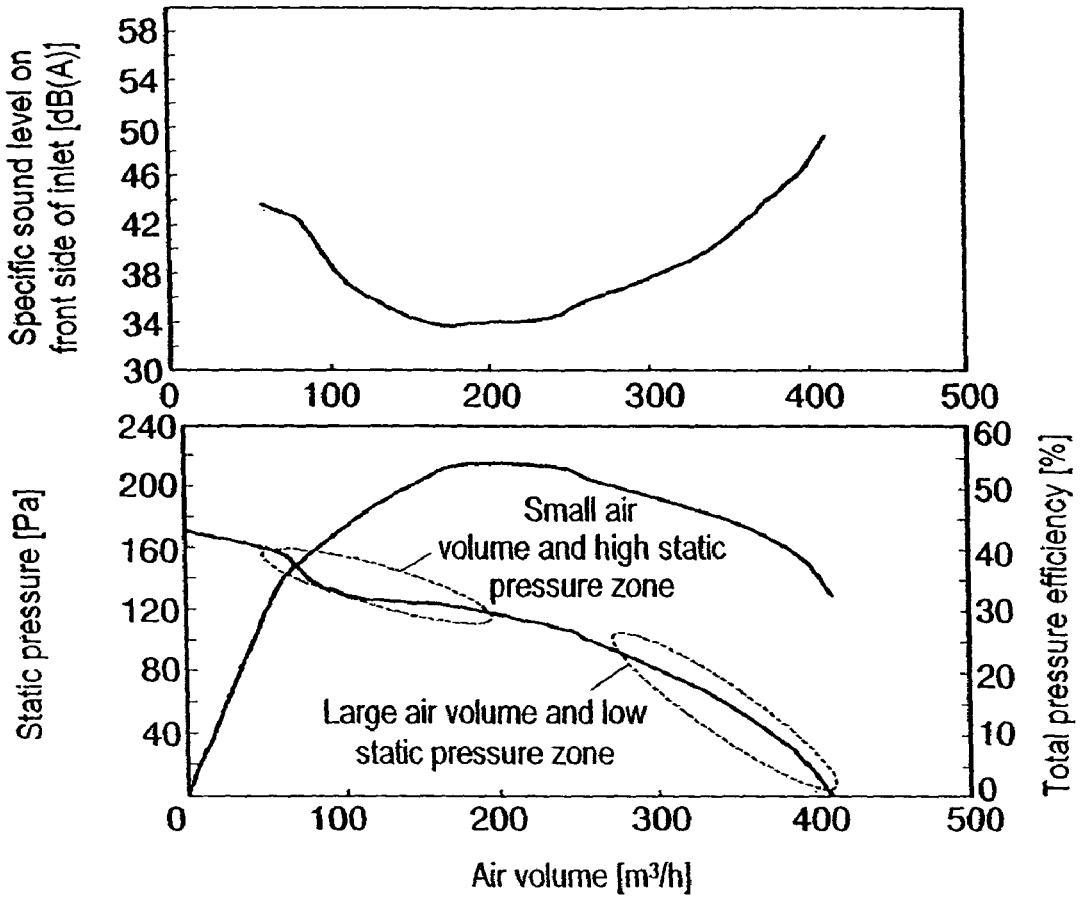
FIG. 20 PRIOR ART
FIG. 20 is its performance characteristic diagram.

FIG. 14 is a sectional side view of the centrifugal fan and casing according to the fourth exemplary embodiment of the present invention.

In this embodiment, for a component with a makeup same as that in the above-mentioned exemplary embodiments, the same mark is given to omit its description.

Blade 1 is formed so that the internal diameter thereof increases from main plate 107 toward lateral plate 105. Specifically, as shown in FIG. 14, the internal diameter has tapered shape 10 in cross section. At the side of lateral plate 105, D1: the internal diameter of a blade, and the internal diameter of orifice 102 increase, and thus the velocity of the axial flow is decelerated when passing through orifice 102, especially in the large air volume and low static pressure zone. Consequently, the radial flow is accelerated when flowing into blade inlet 9, to expand the effective work area of blade 1 at the side of main plate 107. Therefore, the flow velocity between blades can be reduced relatively, thus further suppressing exfoliation on a blade surface and development of a boundary layer.

Fifth Exemplary Embodiment

Figure 21:
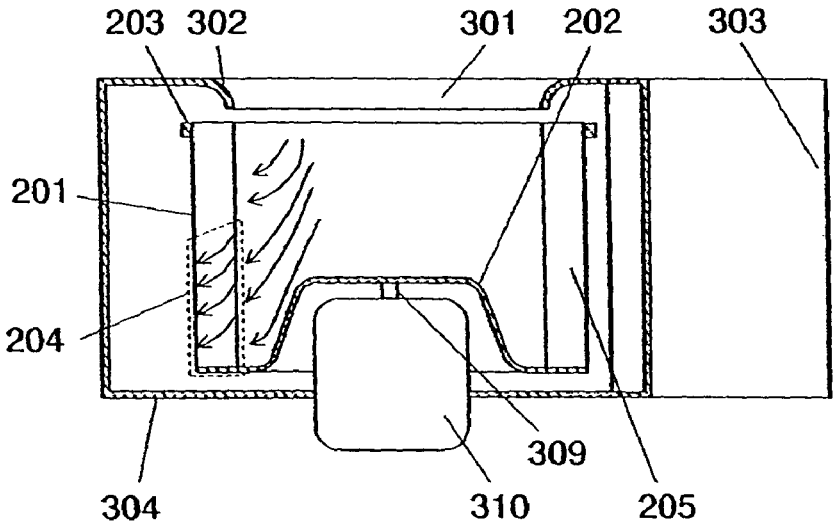
FIG. 21 is a sectional side view of the centrifugal fan and casing according to the fifth exemplary embodiment of the present invention.
Figure 22:
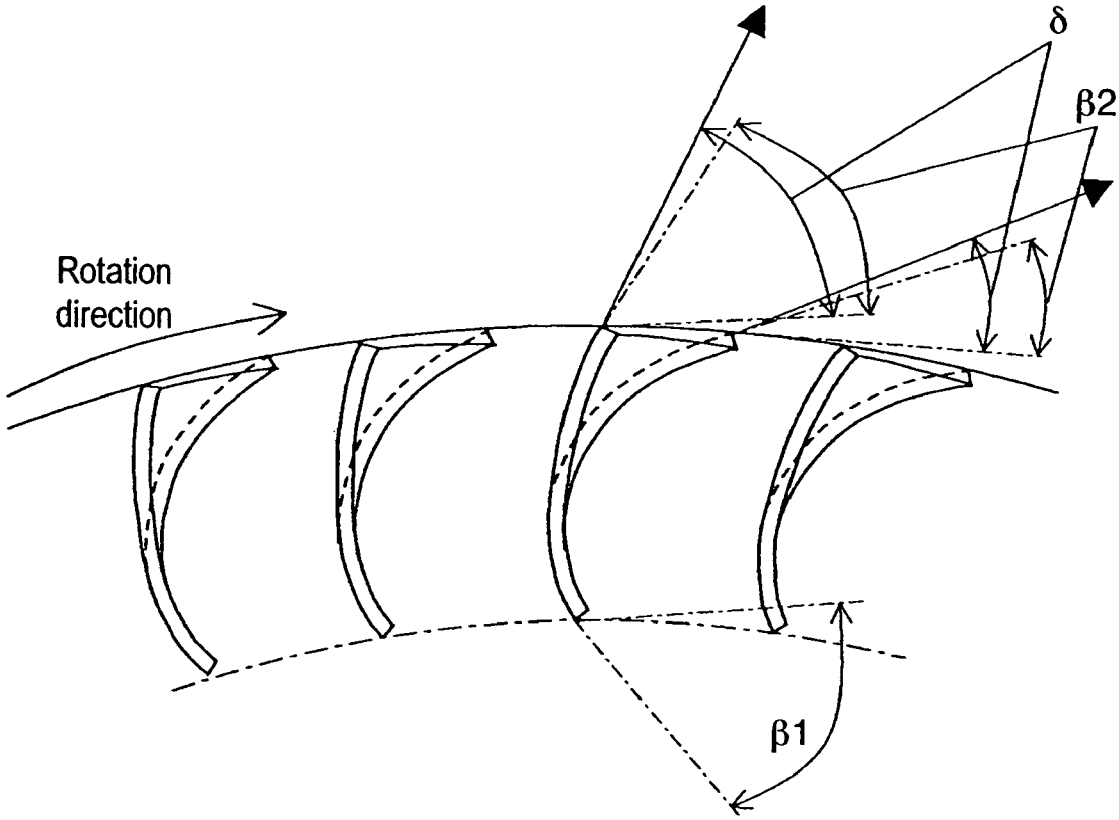
FIG. 22 is a sectional view of the substantial part of the blade shape of the centrifugal fan of the same.
Figure 23A:
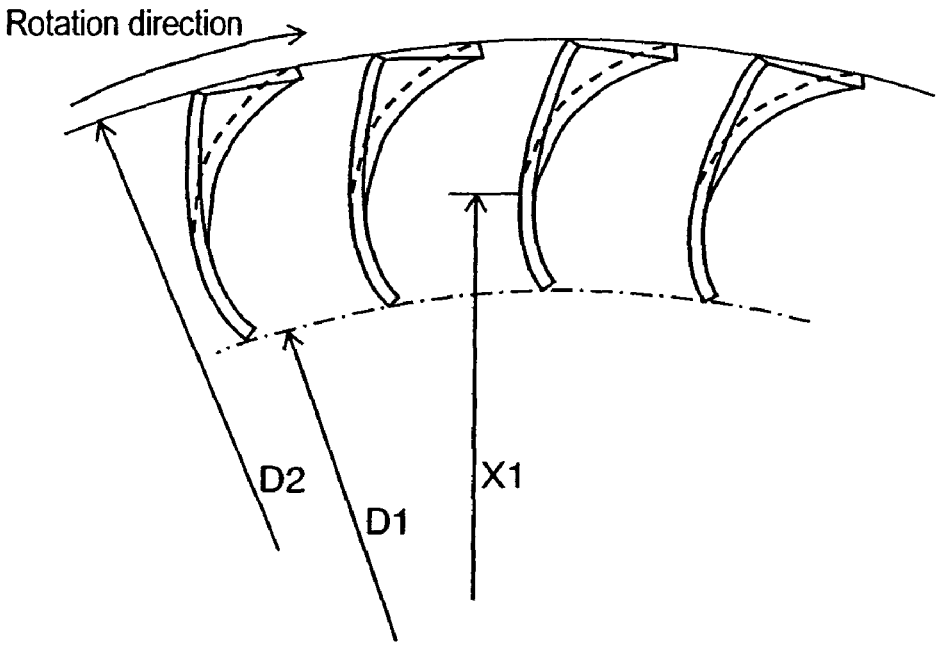
FIGS. 23A and 23B are explanatory sectional views of the substantial part illustrating the blade specifications of the same centrifugal fan.
Figure 23B:
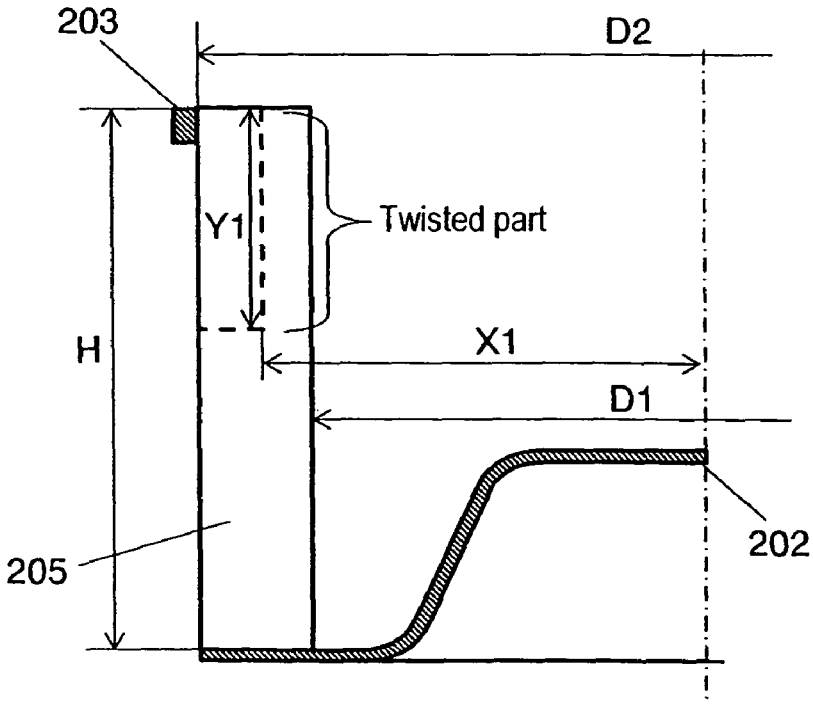
Figure 24:
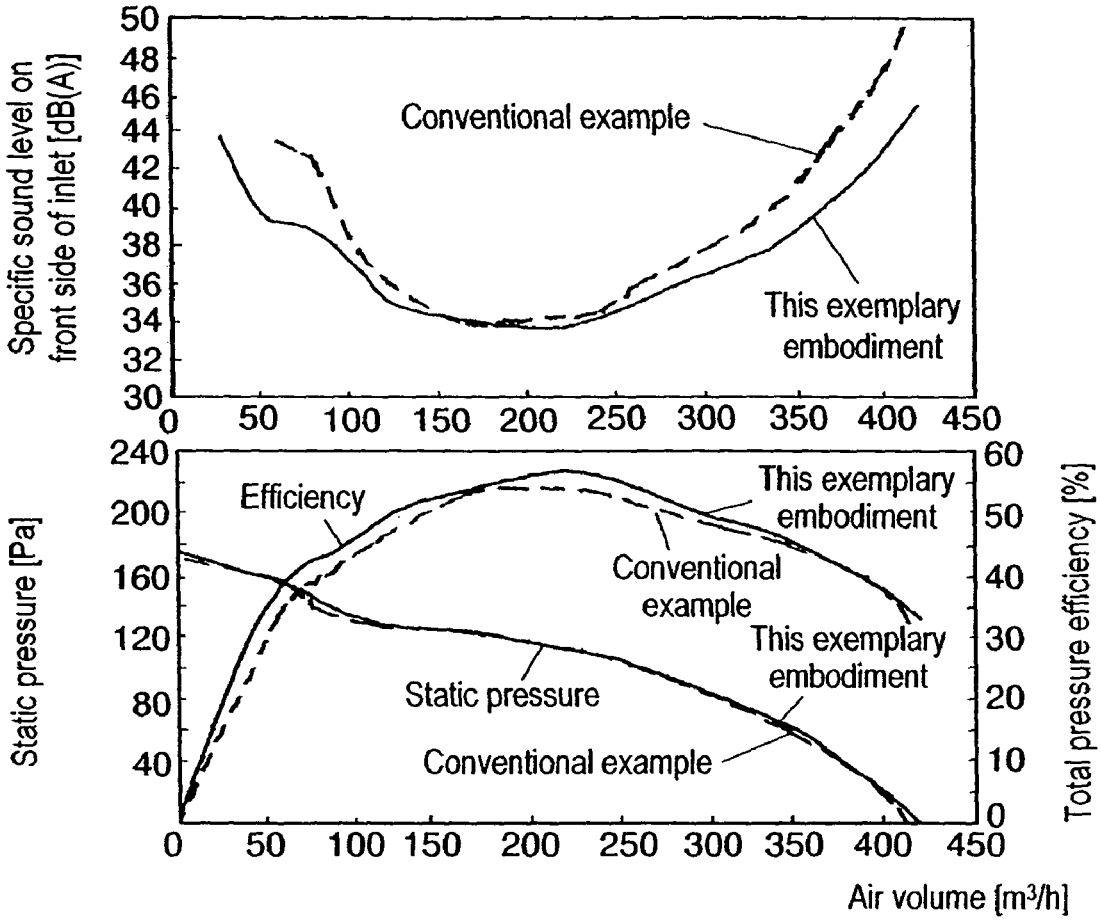
FIG. 24 is a performance characteristic diagram of the same centrifugal fan.
Figure 25:
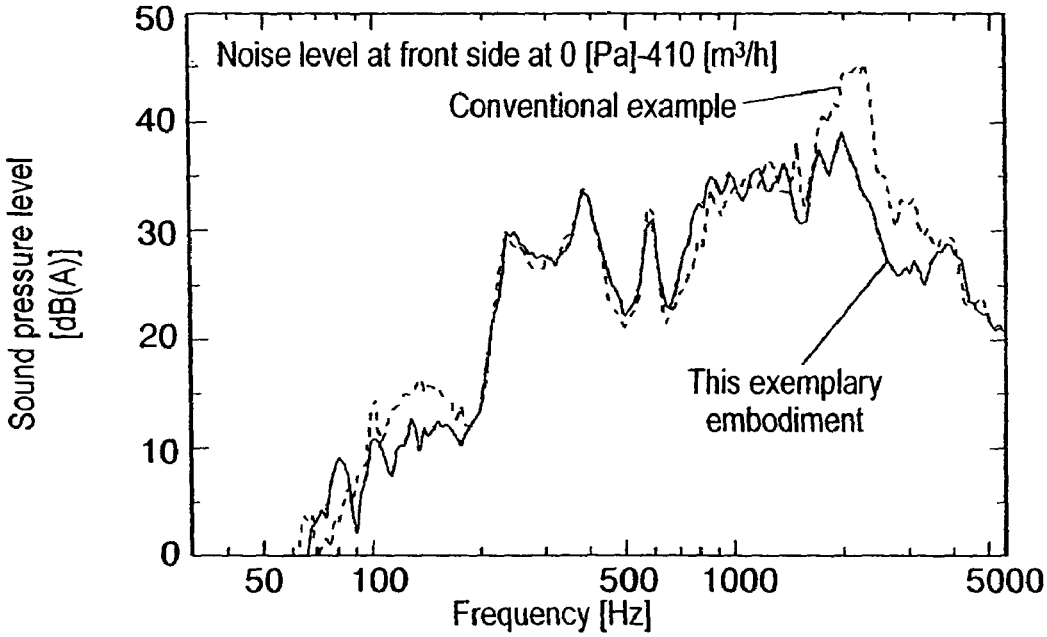
FIG. 25 is a performance characteristic diagram of the same centrifugal fan.

FIG. 21 is a sectional side view of a centrifugal fan and casing according to the fifth exemplary embodiment of the present invention. FIG. 22 illustrates a cross section of the substantial part of the blade shape of the centrifugal fan, along with the airflow. FIGS. 23A and 23B illustrate the specifications of a blade. FIGS. 24 and 25 are performance characteristic diagrams in this embodiment.

Spiral casing 304 is formed at its one side with bellmouth-like inlet 301, and has orifice 302 with the same internal diameter as that of the fan and discharge outlet 303. Casing 304 is provided therein with main plate 202, plural blades 205, and ring-like lateral plate 203. The plural blades 201 are attached so as to be interposed between lateral plate 203 and main plate 202. The plural blades 201 are arranged circularly. Shaft 309 of motor 310 mounted to casing 304 is connected to main plate 202. Main plate 202, lateral plate 203, and plural blades 205 compose a multiblade fan.

As a result that motor 310 rotates, the inhaled air passes through inlet 301 of orifice 302, to flow into the blade inlet. The air that has flown in is pressurized between blades 205, to flow out through the blade outlet. The air that has flown out is gradually converted from dynamical pressure to static pressure when passing through spiral casing 304, to be discharged to discharge outlet 303.

In FIGS. 21 and 22, a part or all of blade outlet 201 is formed so that the blade outlet at main plate 202 moves ahead of that at lateral plate 203 in the rotation direction. In other words, a part or the whole of blade outlet 201 of blade 205 is sequentially twisted from main plate 202 toward lateral plate 203. Therefore, as shown in FIG. 22, 62: the outlet angle of blade outlet 201, varies according to the distance from lateral plate 203. Such a makeup allows mainstream range 204 unevenly distributed in main plate 202 to be expanded toward lateral plate 203 at an operating point in the large air volume and low static pressure zone. Further, at main plate 202, an increase of the flow velocity between blades 205 is alleviated, thus reducing turbulent flow noise involved in exfoliation. Meanwhile, at an operating point in the small flow volume and high static pressure zone, the difference between 62: the outlet angle of blade outlet 1 at lateral plate 203, and 6: the discharge angle, is decreased, thus contracting the exfoliation zone of blade outlet 201 to reduce turbulent flow noise.

A description is made for the detailed specifications of this blade 205 in reference to FIGS. 23A and 23B.

The relationship among X1: the distance between the position where twisting of blade 205 starts and the rotation center of shaft 309; D1: the internal diameter of the fan (plural blades 205 circularly arranged); and D2: the external diameter of the fan, is to be $D1/2<X1\leqq D1/2+0.9(D2-D1)/2$.

The relationship between Y1: the distance between the position where axial twisting starts and lateral plate 3; and H: the blade height, is to be $0.2H<Y1\leqq H$.

FIG. 24 compares the performance characteristic of this embodiment with that of the conventional example. In this embodiment, the noise characteristic and the total pressure efficiency have been improved all over the zone of air volume-static pressure characteristic. FIG. 25 illustrates the frequency characteristic of the noise at 0 Pa and 410 $m^3/h$. In this embodiment, the sound pressure level near 2,000 Hz is significantly reduced.

Sixth Exemplary Embodiment

Figure 26:
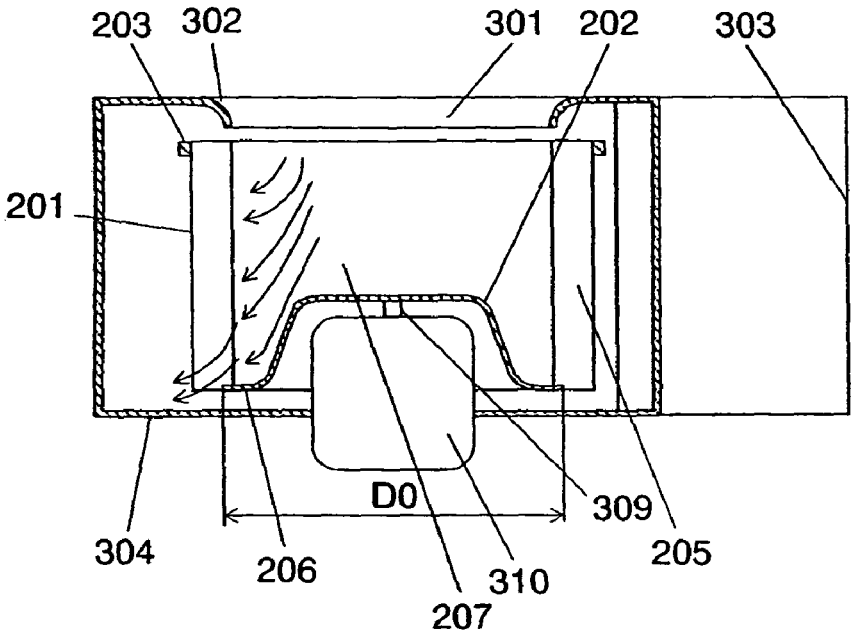
FIG. 26 is a sectional side view of the centrifugal fan and casing according to the sixth exemplary embodiment of the present invention.
Figure 27:
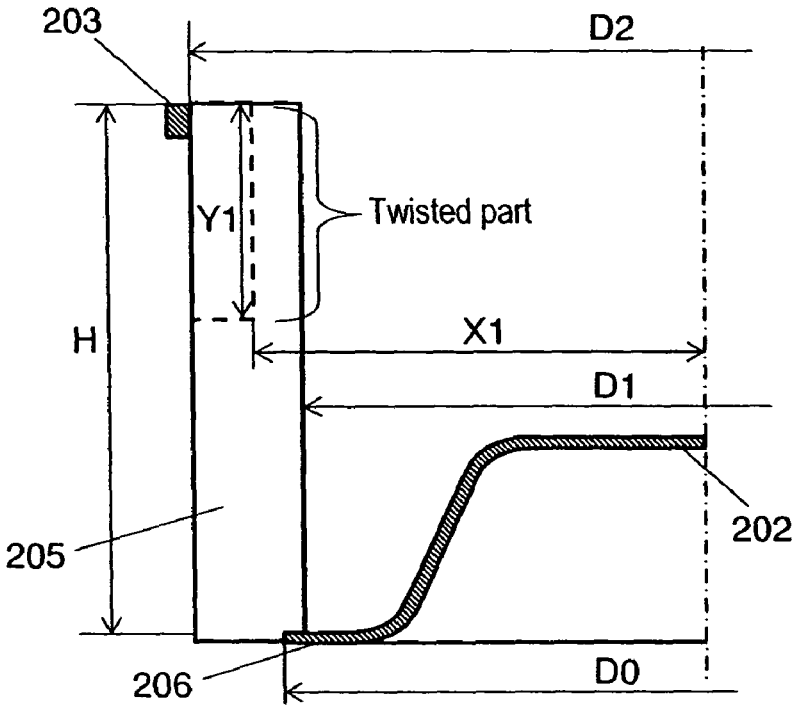
FIG. 27 is an explanatory sectional side view of the substantial part illustrating the specifications of the blade and main plate of the same centrifugal fan.

FIG. 26 is a sectional side view of the centrifugal fan and casing according to the sixth exemplary embodiment of the present invention, and FIG. 27 illustrates the specifications of the blade and main plate.

Here, for a component same as that of the fifth exemplary embodiment, the same mark is given to omit its description.

The relationship between X1: the distance between the position where twisting of blade 205 starts and the rotation center of shaft 309; and D0: the external diameter of main plate 202, is to be $D0\leqq 2*X1$. In other words, D0/2, which is the radius of main plate 202, is equal to or smaller than X1. Blade 205 at the side of main plate 202 expands to end surface 206 of main plate 2 at the opposite side of the lateral plate. In other words, D0: the external diameter of main plate 202, is larger than D1: the internal diameter of the fan.

The above-mentioned makeup alleviates an increase of the flow velocity between blades at main plate 202 at an operating point in the large air volume and low static pressure zone, thus reducing turbulent flow noise involved in exfoliation. Further, this makeup increases the workload of blade 205 at main plate 202 at an operating point in the small flow volume and high static pressure zone, thus preventing a decrease in aerodynamic performance. Moreover, a simple and easy stripping method can be used to produce centrifugal fan 7 with high efficiency and low noise at low cost in a short time.

Seventh Exemplary Embodiment

Figure 28:
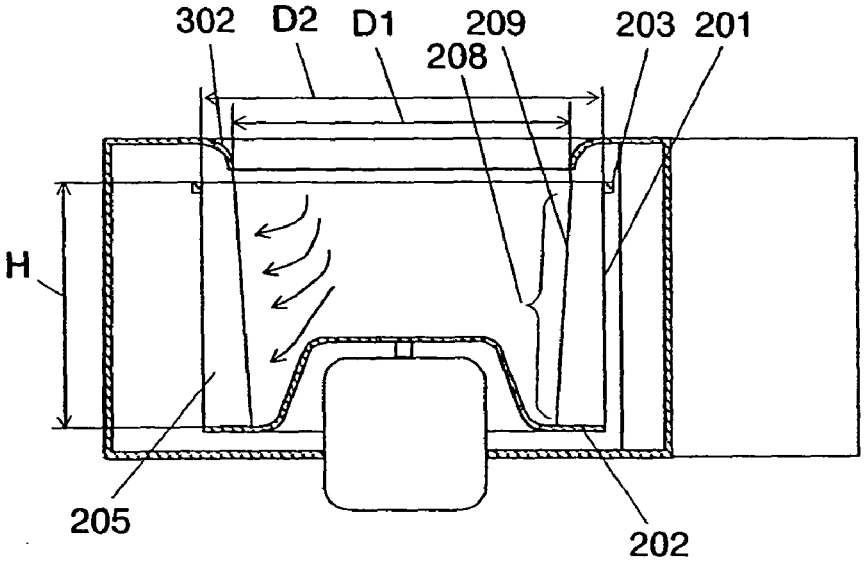
FIG. 28 is a sectional side view of the centrifugal fan and casing according to the seventh exemplary embodiment of the present invention.

FIG. 28 is a sectional side view of the centrifugal fan and casing according to the seventh exemplary embodiment of the present invention.

Here, for a component same as that of the fifth and sixth exemplary embodiments, the same mark is given to omit its description.

In FIG. 28, blade 1 is formed so that the internal diameter thereof increases from main plate 107 toward lateral plate 105. Specifically, as shown in FIG. 28, the internal diameter has tapered shape 208 in cross section. At the side of lateral plate 203, D1: the internal diameter of the fan, and the internal diameter of orifice 102 increase, and thus the velocity of the axial flow is decelerated when passing through orifice 102, especially in the large air volume and low static pressure zone. Consequently, the radial flow is accelerated when flowing into blade inlet 209, to expand the effective work area of blade 205 at main plate 107. Therefore, the flow velocity between blades can be reduced relatively, thus further suppressing exfoliation on a blade surface and development of a boundary layer.

Eighth Exemplary Embodiment

Figure 29:
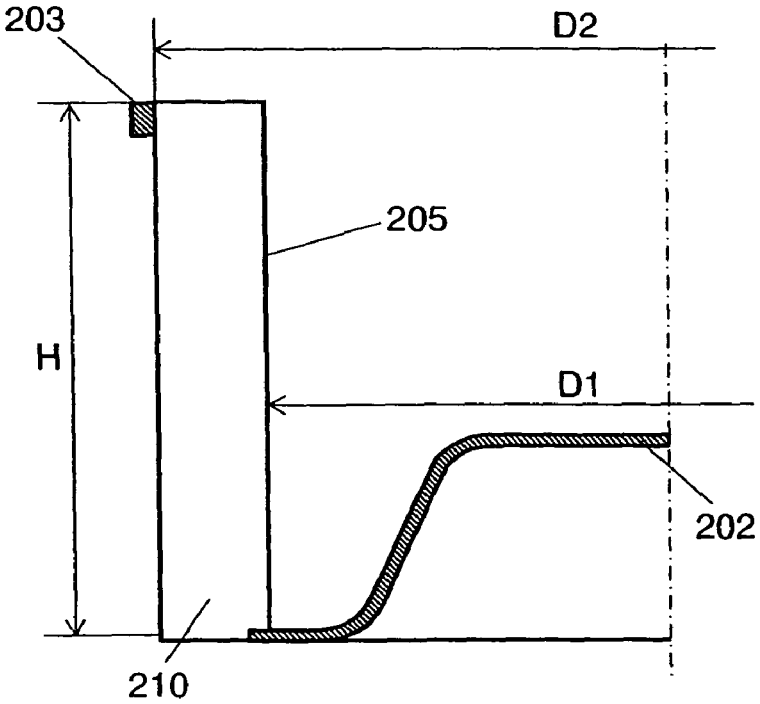
FIG. 29 illustrates the dorsal surface of a blade according to the eighth exemplary embodiment of the present invention.
Figure 30:
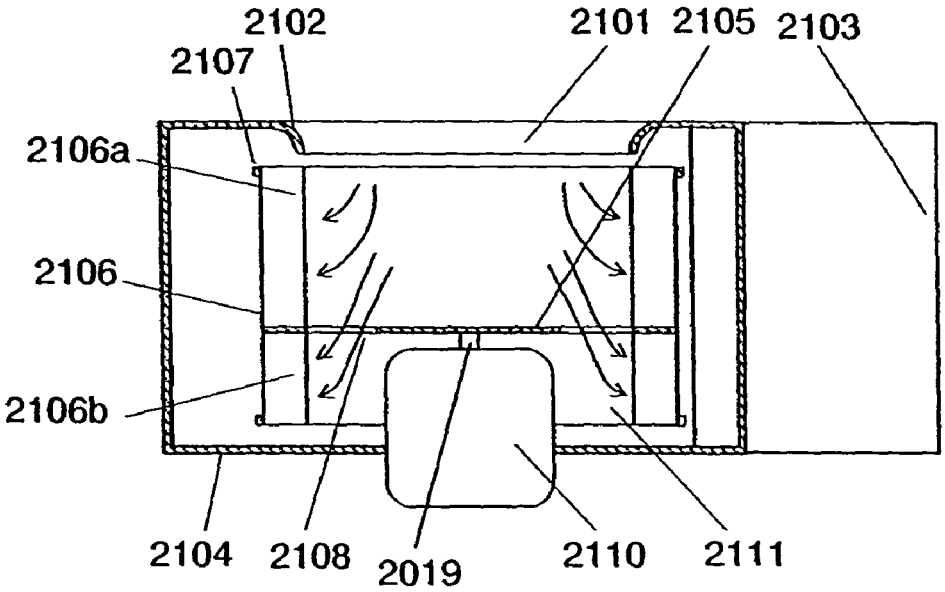
FIG. 30 PRIOR ART
FIG. 30 is a sectional side view of the centrifugal fan and casing in another conventional example.
Figure 31:
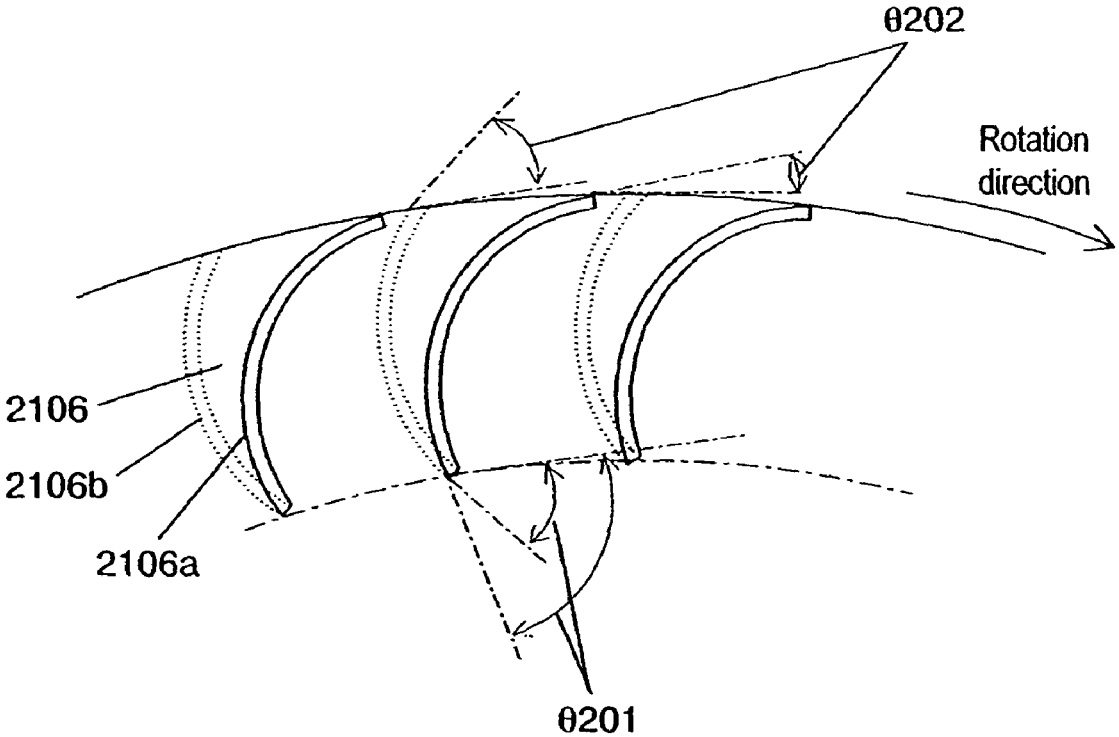
FIG. 31 PRIOR ART
FIG. 31 is a sectional view of its substantial part.
Figure 32:
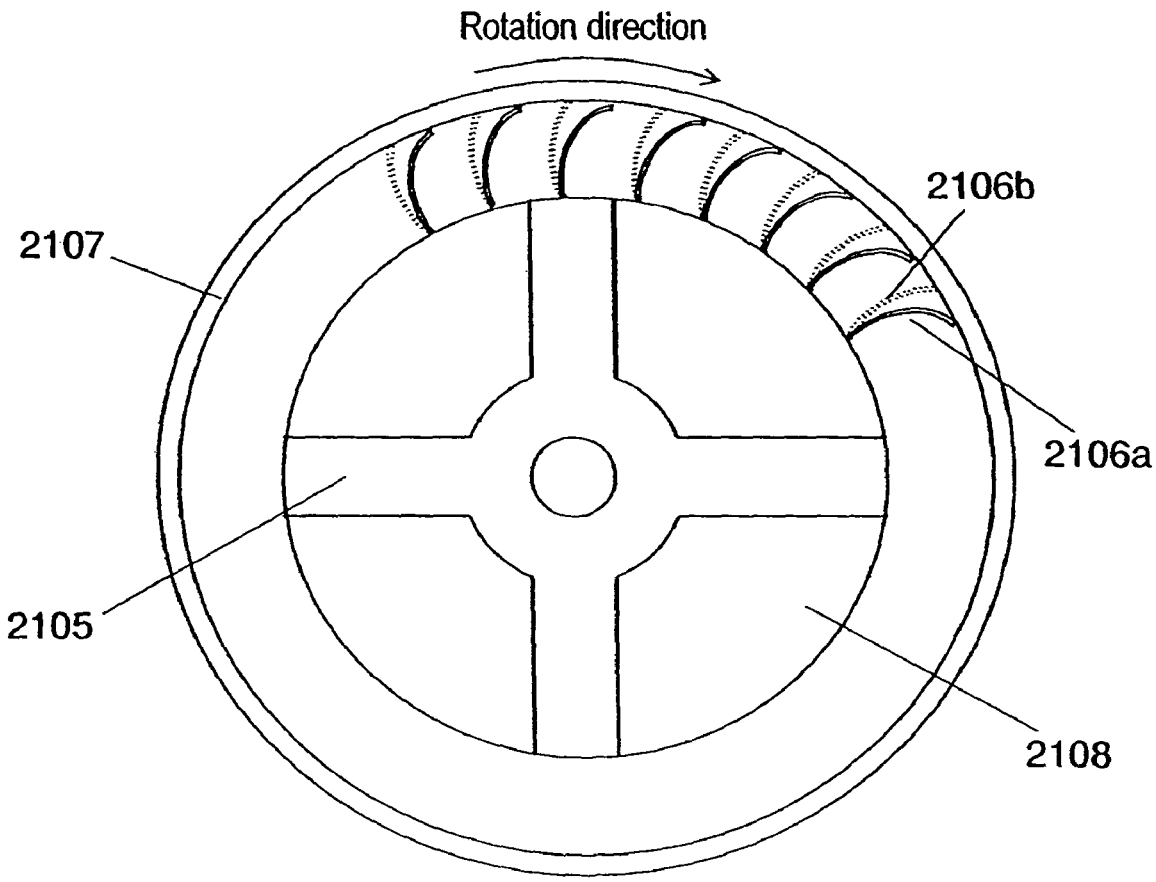
FIG. 32 PRIOR ART
FIG. 32 is a top view of its substantial part.

FIG. 29 illustrates a state of the dorsal blade surface.

For a component same as that of the exemplary embodiments fifth through seventh, the same mark is given to omit its description. In this embodiment, the surface of dorsal side 210 of blade 205 in the exemplary embodiments fifth through seventh is made so as to be rough or to have a large number of asperities. This makeup allows the mainstream range unevenly distributed at the ventral side of blade 205 between blades to be expanded toward the zone of dorsal side 210 of blade 205, thus uniformizing the flow between blades. Then, turbulent flow noise involved in exfoliation and deterioration of efficiency are reduced.

Ninth Exemplary Embodiment

An air conditioner, ventilating blower, air purifier, humidifier, or dehumidifier, with a built-in centrifugal fan according to one of the first exemplary embodiment to the fifth (not illustrated).

INDUSTRIAL APPLICABILITY

A centrifugal fan according to the present invention alleviates collision, exfoliation, and development of a boundary layer, of blades; increases the efficiency in work on a blade surface; and improves the total pressure efficiency of the fan. Further, this fan suppresses the occurrence of turbulent flow noise caused by collision, exfoliation, and development of a boundary layer, and by exfoliation and development of a boundary layer on the dorsal side of the blade. This fan is useful for a ventilating blower, air conditioner, dehumidifier, humidifier, or air purifier.

REFERENCE NUMERALS IN THE DRAWINGS

1 Blade
2 Dorsal side
3 Ventral side
4 Front edge
5 Rear edge
6 Asperities
7 Eddy
8 Blade outlet
9 Blade inlet
10 Tapered shape
X Distance between start point of asperities and rotation axis
f Length of recess
h Depth of recess
t Board thickness of blade
H Height of blade
Y Distance of asperities in direction of rotation axis
101 Inlet
D1 Internal diameter of fan
D2 External diameter of fan
102 Orifice
103 Discharge outlet
104 Casing
105 Lateral plate
106 Throttle
107 Main plate
108 Blade inlet
θ1 Inlet angle
109 Blade outlet
θ2 Outlet angle
110 Blade
111 Centrifugal fan
112 Motor
113 Shaft
14 Inhaled air
201 Blade outlet
202 Main plate
203 Lateral plate
204 Mainstream range
205 Blade
206 End surface at opposite side of lateral plate
207 Centrifugal fan
208 Tapered shape
209 Blade inlet
210 Dorsal blade side
β1 Inlet angle
β2 Outlet angle
δ Discharge angle
D1 Internal diameter of fan
D2 External diameter of fan
X1 Distance between start position of twisting and rotation axis
H Height of blade
Y1 Distance of start position of twisting from lateral plate in axial direction
301 Inlet
302 Orifice
303 Discharge outlet
304 Casing
309 Shaft
θ2 Outlet angle
310 Motor

The invention claimed is:

1. A centrifugal fan comprising:

a plurality of blades circularly arranged, wherein the plurality of blades are interposed between a ring-like lateral plate and a main plate, and integrated;

a casing including therein the plurality of blades, wherein the casing has a discharge outlet, and an inlet with an internal diameter equal to that of the plurality of blades circularly arranged; and a motor with a rotation axis thereof connected to the main plate, wherein the motor is fixed to the casing, wherein each of the plurality of blades has a plurality of asperities on one of the dorsal or ventral sides thereof, wherein a side of the lateral plate of the plurality of blades is arranged at the inlet, wherein the asperities are formed with a projection and a recess alternately repeated from a front edge toward a rear edge thereof in a cross section vertical to a rotation axis of the plurality of blades, wherein the asperities extend in a direction parallel to the rotation axis of the plurality of blades, and wherein the asperities extend an axial distance less than the axial length of the plurality of blades.

2. The centrifugal fan as claimed in claim 1, wherein the main plate has a substantially truncated-cone-shaped throttle projecting toward the lateral plate.

3. The centrifugal fan as claimed in claim 1, wherein an inside of the casing is formed spirally.

4. The centrifugal fan as claimed in claim 1, wherein an internal diameter of the plurality of blades increases from the main plate toward the lateral plate.

5. The centrifugal fan as claimed in claim 4, wherein an internal diameter of the plurality of blades increases linearly from the main plate toward the lateral plate.

6. The centrifugal fan as claimed in claim 4, wherein a shape of the asperities is formed with arcs continuously repeated.

7. The centrifugal fan as claimed in claim 4, wherein a recess of the asperities is triangle.

8. The centrifugal fan as claimed in claim 4, wherein a projection of the asperities is triangle.

9. The centrifugal fan as claimed in claim 4, wherein a shape of the asperities is formed with triangles continuously repeated.

10. The centrifugal fan as claimed in claim 4, wherein a shape of the asperities is formed with quadrangles continuously repeated.

11. The centrifugal fan as claimed in claim 4, wherein X, distance between a rotation center of the plurality of blades circularly arranged and a position at an internal diameter of the asperities, in a direction of a rotation axis, remains constant; and wherein distance between the rotation center and a position at an external diameter of the asperities remains constant.

12. The centrifugal fan as claimed in claim 11, wherein relationship among X which is the distance, D1 which is an internal diameter of the plurality of blades circularly arranged, and D2 which is an external diameter of the same, is to be $D1<2X<D1+0.35(D2-D1)$.

13. The centrifugal fan as claimed in claim 4, wherein relationship among X which is distance from a rotation center of the plurality of blades circularly arranged to a position of the asperities at an internal diameter thereof, D1 which is an internal diameter of the plurality of blades circularly arranged, and D2 which is an external diameter of the same, is to be $D1<2X<D1+0.35(D2-D1)$.

14. The centrifugal fan as claimed in claim 4, wherein a ratio between h which is depth of a recess of the asperities, and t which is board thickness of the plurality of blades, is to be $0.1<h/t<0.7$;

wherein a ratio between f which is width of a recess of the asperities, and h which is the depth, is to be $0.5\ h \leqq f \leqq 2.5\ h$; and wherein relation between Y which is an axial length of the asperities from the lateral plate in a direction of the main plate, and H which is the axial length of the plurality of blades, is to be $0.1<Y/H<1.0$.

15. The centrifugal fan as claimed in claim 1, wherein a recess of the asperities is arc-shaped.

16. The centrifugal fan as claimed in claim 1, wherein a projection of the asperities is arc-shaped.

17. The centrifugal fan as claimed in claim 1, wherein a shape of the asperities is formed with arcs continuously repeated.

18. The centrifugal fan as claimed claim 1, wherein a recess of the asperities is triangle.

19. The centrifugal fan as claimed in claim 1, wherein a projection of the asperities is triangle.

20. The centrifugal fan as claimed in claim 1, wherein a shape of the asperities is formed with triangles continuously repeated.

21. The centrifugal fan as claimed in claim 1, wherein a shape of the asperities is formed with quadrangles continuously repeated.

22. The centrifugal fan as claimed in claim 1, wherein X, distance between a rotation center of the plurality of blades circularly arranged and a position at an internal diameter of the asperities, in a direction of a rotation axis, remains constant; and wherein distance between the rotation center and a position at an external diameter of the asperities remains constant.

23. The centrifugal fan as claimed in claim 22, wherein relationship among X which is the distance from a rotation center of the plurality of blades circularly arranged to a position of the asperities at an internal diameter thereof, D1 which is an internal diameter of the plurality of blades circularly arranged, and D2 which is an external diameter of the same, is to be $D1<2X<D1+0.35(D2—D1)$.

24. The centrifugal fan as claimed in claim 1, wherein the centrifugal fan is included in one of an air conditioner, ventilating blower, air purifier, humidifier, and dehumidifier.

25. A centrifugal fan according to claim 1, wherein the plurality of asperities are formed on most of the one of the dorsal or ventral sides of the plurality of blades.

26. A centrifugal fan according to claim 1, wherein the inlet is a bellmouth inlet.

27. The centrifugal fan as claimed in claim 1, wherein relationship among X which is distance from a rotation center of the plurality of blades circularly arranged to a position of the asperities at an internal diameter thereof, D1 which is an internal diameter of the plurality of blades circularly arranged, and D2 which is an external diameter of the same, is to be $D1<2X<D1+0.35(D2-D1)$.

28. The centrifugal fan as claimed in claim 1, wherein a ratio between h which is depth of a recess of the asperities, and t which is board thickness of the plurality of blades, is to be $0.1<h/t<0.7$;

wherein a ratio between f which is width of a recess of the asperities, and h which is the depth, is to be $0.5\ h<f<2.5\ h$; and wherein relation between Y which is an axial length of the asperities from the lateral plate in a direction of the main plate, and H which is the axial length of the plurality of blades, is to be $0.1<Y/H<1.0$.

* * * * *